United States Patent [19]

Wahl

[11] Patent Number: 4,789,603

[45] Date of Patent: Dec. 6, 1988

[54] VIOLIN FINISH AND FINISHING METHOD

[76] Inventor: Eugene A. Wahl, 460 Ridgewood Ave., Glen Ridge, N.J. 07028

[21] Appl. No.: 114,573

[22] Filed: Oct. 29, 1987

[51] Int. Cl.[4] ..... G10D 1/02; B05D 3/12

[52] U.S. Cl. ..... 428/498; 428/537.1

[58] Field of Search ..... 428/498, 537.1; 84/275

[56] References Cited

U.S. PATENT DOCUMENTS

| | | | |
|---|---|---|---|
| 856,533 | 6/1907 | Lawrence | 84/274 |
| 895,593 | 8/1908 | Stone | 84/274 |
| 966,010 | 8/1910 | Graham | 84/274 |
| 1,234,989 | 7/1917 | Wickstrom | 84/274 |
| 1,622,484 | 3/1927 | Bamberger | 84/274 |
| 1,836,089 | 12/1931 | Schweitzer | 84/274 |
| 1,972,502 | 9/1934 | Tuchfarber | 428/498 |
| 2,516,467 | 7/1950 | Kenyon | 84/274 |
| 4,252,863 | 2/1981 | Song | 428/537 |
| 4,364,990 | 12/1982 | Haines | 428/406 |

OTHER PUBLICATIONS

"Antonio Stradivari, His Life and His Work (1644–1737)" pp. 167–180.

"Violin Making, as it was and is" by Ed. Heron-Allen, pp. 169–186.

*Primary Examiner*—Edith Buffalow

*Attorney, Agent, or Firm*—Anthony J. Casella; Gerald E. Hespos

[57] ABSTRACT

A violin and a method for finishing a violin are provided. The violin comprises a plurality of coats of white shellac applied to the violin and interspersed with at least one color coat. Preferably, the shellac coats comprise a plurality of base coats applied directly to the wood of the violin, and the color coat is applied over the base coats. The color coat preferably comprises a turpentine base. The top coats of white shellac are applied over the color coats. The interior of the violin may also be coated with one or two coats of white shellac.

18 Claims, 1 Drawing Sheet

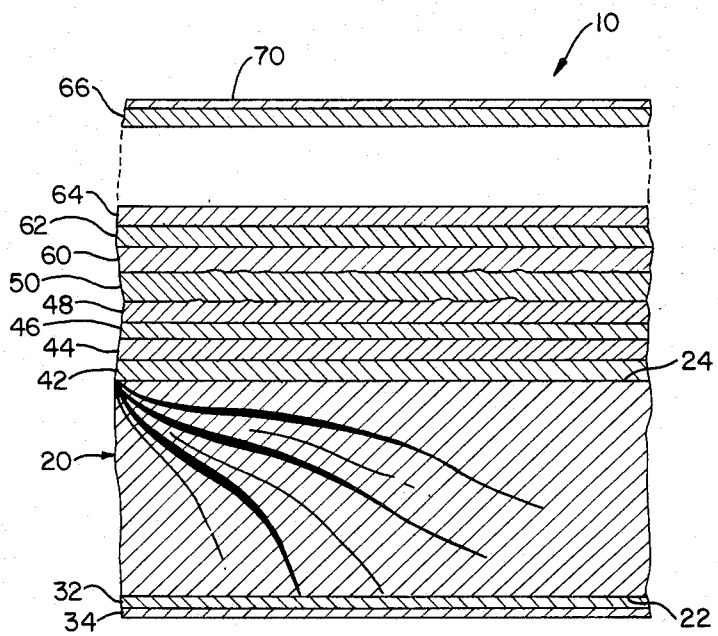
10
70
66
64
62
60
50
48
46
44
42
24
20
32
34
22

VIOLIN FINISH AND FINISHING METHOD

BACKGROUND OF THE INVENTION

Bow played string instruments are known to have existed for approximately five thousand years, as evidenced by the Ravanastron of ancient India. Bow played string instruments evolved over the centuries, and are known to have existed in one form or another at various places in Asia, Europe and Africa.

The violin, in substantially its current structural form, is believed to have originated in Brescia, Italy, in the sixteenth century. Gasparo da Salo who lived from approximately 1555 to approximately 1610 is often credited with being the father of the current violin and of the Brescian school of violin making. The most famous violins originated in Cremona, Italy, beginning in the late sixteenth century and extending into the eighteenth century. The Cremona school of violin making is believed to have been started by Andreas Amati who lived from approximately 1520 to approximately 1580. The violin making techniques of Andreas Amati were passed to his sons Anthony and Jerome Amati and then to Jerome's son Nicholas Amati who was born in 1596 and died in 1684. The art of violin making improved through these generations, and the violins of Nicholas Amati were widely known and valued in Europe in his lifetime. The pupils or apprentices of Nicholas Amati included such famous violin makers as Andrew Guarnerius (1630-1695) and Antonio Stradivari (1644-1737) who is widely acknowledged as the greatest violin maker of all time. The Cremona violins of the seventeenth and eighteenth centuries, and particularly the violins of Stradivari have increased substantially in value since they were made. Violins that were sold originally by Stradivari for the equivalent of $20–$50 now command prices of $500,000–$1,000,000.

The increasing value of the violins made by the Cremona masters such as Stradivari is largely attributable to the enduring quality of those instruments. In particular, the violins crafted by Stradivari and other Cremona masters are widely acknowledged for their superior tonal qualities, and their brilliantly lustrous finish which have lasted for the 200–300 year lives of the instruments.

Despite the many volumes written on the secrets of the Cremona violin masters, much of their violin making is truly a lost art. In particular, although violin makers and craftsmen have been able to produce violins dimensionally identical to the Stradivari violins, craftsmen have been unable to learn or duplicate the secrets of the tone and the finish of the violins associated with Stradivari and the other Cremona masters. It is reported that Stradivari had maintained a written record of his finishing secrets, and had kept this record hidden in a family Bible. After the death of Antonio Stradivari in 1737, the secret document was discovered by his son who promptly destroyed the document to ensure that his father's art could never be duplicated.

It is generally acknowledged that the finish applied to the violin affects both the appearance and the tone of the instrument. Hill et al in their work entitled "Antonio Stradivari His Life and His Work (1644–1737)" explained that: "It should be remembered that a violin must vibrate freely, yet not too freely, as would be the case with a newly unvarnished instrument when first in use. Clothe it too thickly with even a good varnish, and the tone will be deadened, or with one too hard in texture, and the result will be that the tone will prove hard and metallic. Or again, cover it with a too soft oil varnish, and you will mute the tone of your instrument for a generation, if not forever."

Many attempts have been made to explain the lost art of Cremona violin finishes and to develop new finishes that approach the tonal qualities and appearances of the Cremona violins. Hill et al, in their above identified work, hypothesized that Stradivari merely employed available oil-based varnishes and that the superior visual and tonal results are attributable to the master's fine hand and application techniques. The patent literature includes several complex attempts to define a finish which yields visual and acoustical results comparable to the old Cremona violins. For example, U.S. Pat. No. 1,083,510 which issued to Tietgen on Jan. 6, 1914 indicates that the violin should receive two coats of a solution formed initially with nine parts alcohol, three parts nitric acid and six parts turpentine. The solution is allowed to stand at least six months until crystals form on the bottom. The remaining liquid is decanted and then added to a solution of three parts gum mastic and nine parts turpentine. After two coasts of the resulting finish are applied to the violin, the instrument is dried for six days, after which a coat of commercial nitric acid is applied. Additional coats of hot varnish are then applied to the violin, with still additional coats of alcohol applied to selected parts of the instrument.

U.S. Pat. No. 1,234,989 issued to Wickstrom on July 31, 1917, and suggests that the most desirable coating is achieved by ensuring that the varnish does not become intimately connected to the instrument. To achieve this end, U.S. Pat. No. 1,234,989 teaches an initial coating of hot beeswax. Excess beeswax is rubbed off, and the instrument is next coated with plural layers of a mastic dissolved in alcohol. The reference teaches that the mastic layer will not adhere to the beeswax, and as a result, the substrate consisting of the wood and the beeswax can vibrate free of the top coats.

U.S. Pat. No. 1,622,484 which issued to Bamberger on Mar. 29, 1927 suggests finishing the violin with any available coating material such as shellac, varnish, lacquer or the like that has been treated with a fruit or vegetable juice, and preferably onion juice.

U.S. Pat. No. 1,836,089 issued to Schweitzer on Dec. 15, 1931 and suggests that the varnish employed on the violin body has little effect on the tone of the instrument, and further suggests that the treatment of the sounding board with ultraviolet rays is the secret to enhanced acoustics of the Italian violins. On the other hand, U.S. Pat. No. 856,533 which issued to Lawrence on June 11, 1907 suggests that the enhanced tone is achieved by treating the interior of the violin with a composition consisting of alcohol, gum of guaiac, orange peels and ether.

U.S. Pat. No. 4,252,863 which issued to Song on Feb. 24, 1981 suggests that the desirable tones are achieved by treating the wood of the violin with heat for one to two months, coating the treated violin with iodine, and subsequently heating the violin again at 300° F. for from two to seven days. The wood is then scraped and coated with an undefined varnish material.

The non-patent literature also is replete with divergent examples of the ideal way to treat and/or coat a violin. A typical example is an article dated Oct. 29, 1917 in the "Music Trades" publication which reports that the violin is coated with a combination of varnish, Chinese amber and acid. More recently, it has been suggested that the brilliant luster associated with the Cremona violins is attributable to a fungus that existed in Italy at that time and that affected the chemistry of the wood and/or a varnish applied to the wood. Further discussions of violin finishes are given in the above identified Hill et al work and in "Violin Making: As It Was, And Is" by Ed. Heron-Allen. The disclosure of the prior art identified above is incorporated herein by reference.

None of the finishing methods or compositions described above have received either commercial success or critical acclaim from people skilled in the art of violin making and playing. As a result, the vast majority of violins continue to be finished with spirit based varnishes. These varnish finished violins simply do not approach the visual or acoustical qualities associated with the violins of Stradivari and the other Cremona masters.

Shellac has been available as a coating material since as early as 1300 B.C., where it was used, in one form or another, in southern and southeastern Asia. Shellac is formed from a gum or resin exuded from Croton or Fiscus species trees indigenous to southern Asia. In particular, the gum is exuded from incisions made by female insects of the Coccus lacca species. The gum is soluble in alcohol to yield a transparent or semi-transparent coating. The bodies of these same insects were used to form lac dye which was a coloring medium for wood.

Lac dye is generally unavailable today as a commercial product, and various synthetic dyes are used for coloring mediums. Lac gum, on the other hand, is known to be mixed with an alcohol base to yield a quick drying protective "shellac" coating. White or bleached lac gum is known to provide a protective shellac coating having a high degree of transparency.

Although shellac has been readily available for centuries, it is generally not considered to be an acceptable coating material for fine and valuable wood products. In particular, shellac is known to yield a noticeably imperfect finish in the presence of water. Thus, shellac generally cannot be applied in environments of high humidity. Furthermore, even a fully cured shellac finish does not weather well in the presence of water. For these reasons, shellac is not commercially used for finishing fine pieces of furniture or violins.

In view of the above, it is an object of the subject invention to provide a violin which has aesthetic and acoustical properties similar to or better than the violins crafted in Cremona, Italy, in the seventeenth and eighteenth centuries.

It is another object of the subject invention to provide a method for coating a violin to achieve a deep and brilliant luster and to provide exceptional acoustical characteristics.

A further object of the subject invention is to provide a violin with a deep luster that appears to be generated from within the coating.

Still a further object of the subject invention is to provide a violin with an extremely durable finish.

An additional object of the subject invention is to provide a violin which when hand rubbed will retain its original luster.

Still another object of the subject invention is to provide a method for efficiently coating violins to yield an instrument with enhanced visual and acoustical properties.

SUMMARY OF THE INVENTION

The subject invention is directed to a violin, the exterior of which is coated with plural layers of shellac and at least one color coat. The color coat may be a lac dye in a suitable solvent or a synthetic dye in a solvent of alcohol or spirits, with turpentine being preferred. Preferably, the violin comprises plural coats of white shellac over the color coat. The interior of the violin may also be coated with a sealant, which preferably is one or more coats of a white shellac.

In a preferred embodiment, between two and four base coats of the white shellac are applied to the exterior of the violin. The color coat then is applied over the base coats of white shellac, on all but the neck of the violin. Preferably, the color material is in a spirit solvent. The spirit of the color coat will not interact with the alcohol based shellac base coats initially applied to the violin. As a result, these white shellac base coats will retain their luster and hardness despite the subsequent application of the spirit based color coat. It has been found that the initial 2–4 base coats of white shellac will permit some penetration of the spirit based color coat into the wood, and particularly into the less dense or darkened areas of the wood grain, thereby yielding a desirable array of shading which accents the natural grain pattern of the wood.

After the color coat has been permitted to cure adequately, additional plural layers of white shellac are applied thereto, to define top coats. Preferably, at least approximately 12 additional top coats of white shellac are applied over the color coat.

A final microscopic film of linseed oil may be applied over the last top coat of white shellac to act as a plasticizer to prevent the plural shellac top coats from becoming excessively brittle.

In the preferred method, the one or two coats of sealant, and preferably shellac, are applied first to the interior of the violin. These two interior coats will not yield a visible film on the interior of the violin. From 2 to 4 base coats of white shellac then are applied directly to the wood on the exterior of the violin. Each coat of shellac generally will be dry to the touch in approximately 15 minutes, and will accept a subsequent coat after 30 minutes without the preceding coat being redissolved by the alcohol base of each subsequent coat. The color coat is applied over the initial layers of white shellac, after the last of the initial layers has been permitted to dry for at least one half hour. Preferably the color coat employs a turpentine base and is permitted to dry for approximately one day. After such curing of the color coat, plural top coats of white shellac are applied thereto, with at least one half hour drying time between successive coats. In the preferred embodiment, at least approximately 12 such top coats of white shellac are applied over the color coat.

The resulting product has been found to exhibit superior visual and acoustical properties. In particular, it has been found that the transparent white shellac top coats provide an exceptionally brilliant luster. Light reflecting off the color coat has been found to diffract as it passes through the plural top coats of white shellac. Additionally, some light will pass through the color coat and will reflect back off the clear shellac base coats to create a visually extraordinary color effect. This unique effect is not found in currently manufactured violins, and resembles the "flame from below" used to describe the unusual and heretofore inimitable effect associated with the violins of Stradivari and other Cremona masters. It has also been found that the violin coated as described herein achieves acoustical effects that are superior to the effects achieved by otherwise identical violins that have been coated with the prior art varnishes and associated methods.

BRIEF DESCRIPTION OF THE DRAWING

The drawing is a schematic cross-sectional view of a portion of a violin coated in accordance with the subject invention.

DETAILED DESCRIPTION OF THE PREFERRED EMBODIMENT

The violin of the subject invention is indicated generally by the numeral 10 in the accompanying Figure. More particularly, the accompanying Figure depicts a portion of the violin corresponding to the belly, back or sides of the violin. The violin 10 includes a wood substrate 20 which typically is a maple for the back or a pine for the belly or front of the violin. The wood 20 of violin 10 comprises an inwardly facing or interior surface 22 and an outwardly facing or exterior surface 24. The interior surface 22 of the violin 10 is coated with layers 32 and 34 of a white shellac. It has been found that the interior coats protect against atmospheric moisture changes. However, these coats do not form a visible film on the interior of the violin. It has also been found that these interior coats have the extraordinary effect of enhancing the volume and projection of the sound emanating from the violin.

The exterior surface 24 of the violin 10 is first successively coated with coats 42–48 of white shellac to define a base or first layer. The white shellac employed for the coats 42–48 preferably is formed from commercially available shellac dissolved in an alcohol base. The shellac may be formulated to define a concentrated solution of shellac in ethanol or methanol. The preferred shellac solution defined a saturated solution of white shellac flakes in 95% ethanol. In particular, the shellac flakes were thoroughly mixed with the 95% ethanol and then the solution was allowed to stand for at least one hour and remixed. A precipitate of undissolved shellac flakes remained at the bottom, and the supernatant was used for the coating. The white shellac coats 42–48 comprising the first layer may be applied by brush, but other coating techniques are believed to be equally acceptable. From 20 to 60 minutes should be allowed to elapse between successive base coats 42–48 to allow the shellac gum to cure and harden sufficiently to avoid being redissolved by the alcohol base in subsequent base coats 44–48. Generally about 30 minutes has given satisfactory results. Although four base coats are depicted, fewer than four base coats have been tested and found to yield similar visual effects. However, too many base coats may completely prevent the penetration of the color coat into the wood, thereby eliminating the desirable accentuation of the grain.

A color coat 50 comprising a commercially available dye, such as alizarin, is dissolved in turpentine and then is applied to the base coat 48. The alizarin produces a reddish brown color coat. Other available dyes may be employed for different color shades. The color coat may comprise from 0.1% to 2.5% by weight alizarin, and preferably 1.0% of the alizarin in turpentine. The concentration may vary with other dyes and spirits, and in accordance with the desired color effects. The turpentine of the color coat 50 will not dissolve the shellac of base coats 42–48. However, the areas of the wood 20 that are less dense will not be completely sealed by the base coats 42–48. In these areas, the color coat 50 will migrate into and stain the wood 20. In other locations, the color coat 50 will merely provide a coating that will cover but not penetrate the base coats 42–48. The color coat 50 with the turpentine base will require longer to dry before additional coats can be applied. Preferably, the color coat 50 is allowed to dry for one day.

Top coats 60–66 of the above described white shellac are applied to the color coat 50 by substantially the same application method. The alcohol base of the top coats 60–66 will not interact with the color coat 50 provided that sufficient time has elapsed for the color coat 50 to completely dry. In the preferred embodiment, at least twelve top coats of white shellac are applied over the color coat 50, with at least one half hour of drying time between the applications of successive top coats 60–66.

A very fine microscopic plasticizing coat 70 of a drying oil such as boiled linseed oil may be applied to the final top coat 66. Other drying oil may be employed. The oil coat application preferably comprises one or two drops of the oil placed on a soft cloth, and rubbed over the entire violin exterior.

Violins produced as described above and depicted in the accompanying figure have been made and tested both visually and acoustically. The violins have exhibited a brilliant gloss that is not found in currently manufactured violins, and also exhibit superior acoustical characteristics. With respect to the visual characteristics, it has been observed and noted that the lustrous color of the violin 10 described above, appears to be emanating from below the surface. The reasons for the observed visual phenomena are not known. However, without attempting to limit or operationally define the invention, it is believed that these unusual visual characteristics may be attributable to two simultaneous visual phenomena. First, the incident light rays to the color coat 50 may be diffracted as they pass through the plural top coats 60–66. Additionally, the color coat 50 is not opaque, but rather translucent to permit light rays to pass therethrough. The light rays passing through the color coat 50 may reflect off the base coats 42–48 and may be retransmitted through the color coat 50 and the top coats 60–66, with additional diffraction of the light rays.

Over 260 unfinished violins were purchased from a single source in Mittenwald, Germany, for experimentation that led to the violin and method disclosed herein. Visually striking and acoustically fine violins were made by applying the above described turpentine based color coat directly to the wood of the violin, and applying the white shellac top coats thereto. However, visually superior violins were achieved when the base coats of white shellac 42–48 were applied to the exterior surface 24 of violin 10 prior to applying the color coat 50. Similar visual effects with different color variations were achieved by applying additional color coats similar to the color coat 50 interspersed between plural layers of the top coats 60–66. These violins were compared with violins purchased from the same source and coated with the prior art varnishing techniques. The visual results and differences were unexpected and striking. Furthermore, violins coated as depicted in the Figure, or in the slight variations thereto as described above, were noted to achieve a greater acoustical fullness and brilliance and a distinctly mellow reediness. The instruments were also very responsive to the bow.

In summary, a violin with enhanced visual appearance and acoustical performance is provided by coating the exterior surface with plural coats of white shellac interspersed with at least one color coat. Preferably, between two and four base coats of white shellac are initially applied to the exterior of the violin. A color coat comprising a dye medium in a turpentine base is then applied to the base coats of white shellac, and a plurality of top coats of white shellac are applied over the color coat. Preferably, at least twelve top coats of white shellac are applied over the color coat. White shellac may also be applied to the interior of the violin to further enhance acoustical performance and to minimize effects of atmospheric changes on the performance of the violin.

While the invention has been described with respect to certain preferred embodiments, it is apparent that various changes can be made without departing from the scope of the invention as defined by the appended claims.

I claim:

1. A wood violin having a multi-layer finish comprising as the first layer at least one coat of shellac, as the second layer at least one color coat comprising a dye dissolved in a spirit base, and as a third layer a plurality of said shellac coats being disposed over said color coat.

2. A violin as in claim 1 further comprising at least one coat of shellac applied to the interior of said violin.

3. A violin as in claim 1 further comprising as a fourth layer a coat of a drying oil.

4. A violin as in claim 1 wherein said first layer comprises between two coats and four coats of shellac.

5. A violin as in claim 1 wherein said plurality of coats of said third layer comprise between four coats and sixteen coats of shellac.

6. A violin as in claim 1 wherein said plurality of coats of said third layer comprise at least four coats of shellac.

7. A violin as in claim 1 wherein the first layer is provided by a white shellac comprising a shellac gum dissolved in an alcohol base.

8. A violin as in claim 7 wherein the third layer is provided by a white shellac comprising a shellac gum dissolved in an alcohol base.

9. A violin as in claim 8 further comprising at least one coat of white shellac applied to the interior surface of the interior of the violin which is provided by a white shellac gum dissolved in an alcohol base.

10. A violin as in claim 7 comprising between two and four base coats applied to the exterior of the violin.

11. A violin as in claim 10 comprising at least four top coats of white shellac applied to said color coat.

12. A method for finishing a wooden violin, said method comprising the steps of: forming a first layer on the exterior surface of the violin by applying at least one coat of white shellac to the exterior surface of the violin; forming a second layer by applying a color coat over said first layer, said color coat comprising a dye dissolved in a spirits base; and forming a third layer by applying a plurality of top coats of white shellac successively over said color coat.

13. A method as in claim 12 wherein the interior surface of said violin is coated applying at least one coat of shellac to said interior surface.

14. A method as in claim 12 wherein the step of applying said first layer comprises applying between two and four coats of white shellac successively, and allowing each of said coats to dry before applying the next successive coat.

15. A method as in claim 14 wherein said third layer of a plurality of top coats comprises at least four top coats of white shellac.

16. A method as in claim 14 wherein said third layer of a plurality of top coats comprises between 12 and 16 top coats of white shellac.

17. A method as in claim 14 further comprising forming a fourth layer by applying a coat of drying oil over said third layer.

18. A method as in claim 17 wherein the drying oil is boiled linseed oil.

* * * * *